United States Patent [19]

Cameron et al.

[11] Patent Number: 4,996,938

[45] Date of Patent: Mar. 5, 1991

[54] APPARATUS FOR PROPELLING A USER IN AN UNDERWATER ENVIRONMENT

[75] Inventors: Michael H. Cameron; James F. Cameron, both of Bermuda Dunes, Calif.

[73] Assignee: American Gothic Productions, Palm Desert, Calif.

[21] Appl. No.: 391,099

[22] Filed: Aug. 8, 1989

[51] Int. Cl.[5] ..... B63G 8/00

[52] U.S. Cl. ..... 114/315; 440/6

[58] Field of Search ..... 440/6, 38, 40, 49, 53; 114/315, 312, 330, 337, 338; D12/308

[56] References Cited

U.S. PATENT DOCUMENTS

| | | | |
|---|---|---|---|
| 3,084,654 | 4/1963 | Rosenberg | 114/315 |
| 3,442,240 | 5/1969 | Wild | 114/315 |
| 3,503,356 | 3/1970 | Wilson | 114/315 |
| 3,548,771 | 12/1970 | Hastings | 114/315 |
| 3,650,234 | 3/1972 | Gossdy | 114/315 |
| 3,685,480 | 9/1972 | Peroni | 114/315 |
| 3,757,719 | 9/1973 | Strickland | 114/315 |
| 3,768,431 | 10/1973 | Picken | 114/315 |
| 3,890,920 | 6/1975 | Buelk | 114/315 |
| 4,602,589 | 7/1986 | Quinato | 114/315 |
| 4,813,367 | 3/1989 | Stevenson | 114/315 |

*Primary Examiner*—Sherman Basinger
*Assistant Examiner*—Clifford T. Bartz
*Attorney, Agent, or Firm*—Blakely, Sokoloff, Taylor & Zafman

[57] ABSTRACT

An apparatus is disclosed for propelling a person in an underwater environment. The apparatus includes a hull assembly for maintaining the apparatus at the desired level of buoyancy, the hull assembly having a longitudinal axis. Support means are provided for allowing the person to position the hull assembly at the desired angular orientation relative to himself. Thruster means are connected to the hull assembly for propelling the apparatus through the water. The thruster means are positionable at the desired angular orientation relative to the longitudinal axis of the hull assembly. The hull assembly is angularly oriented independently of the direction of the movement of the apparatus. Means are provided for connecting the thruster means to the hull assembly.

17 Claims, 5 Drawing Sheets

APPARATUS FOR PROPELLING A USER IN AN UNDERWATER ENVIRONMENT

BACKGROUND OF THE INVENTION

1. Field of the Invention

This invention relates to underwater propulsion devices and more particularly to an apparatus for propelling an individual underwater utilizing dual thrusters which are rotatable relative to the direction of the hull of the device.

2. Description of the Related Art

For underwater photographic purposes, there has been a long felt need to have a personal propulsion vehicle with increased maneuverability. Specifically, there has been a need for a vehicle which has the capability of aiming the lens of an attached underwater movie camera in one direction while the device, as a unit, is being propelled in another flight attitude. Such capabilities have been lacking in current propulsion vehicles, resulting in cinematic limitations for underwater photography.

The present inventors are aware of an underwater propulsion device utilizing two thrusters which are rigidly fixed to the hull of the craft. The vehicle is designed with a manta ray-type shape with a handle rigidly affixed on the back end thereof for controlling the direction of travel. Use of the handle affixed to the back end results in maneuvering deficiencies denying a wide degree of underwater photographic effects.

It is a principal object of the present invention, therefore, to provide an underwater propulsion vehicle which has improved maneuverability over presently available underwater craft. It is another object to provide an efficient underwater vehicle with the capability of supporting a camera and aiming the camera in the desired direction regardless of the direction of travel of the vehicle.

SUMMARY OF THE INVENTION

These and other objects are achieved by the present invention which is an apparatus for propelling a person in an underwater environment. The apparatus comprises a hull assembly for maintaining the apparatus at the desired level of buoyancy. The hull assembly has a longitudinal axis. Support means are provided for allowing the person to position the hull assembly at the desired angular orientation relative to himself. Thruster means are connected to the hull assembly for propelling the apparatus through the water. The thruster means are positionable at the desired angular orientation relative to the longitudinal axis of the hull assembly. The hull assembly is angularly oriented independently of the direction of the movement of the apparatus. Means are provided for connecting the thruster means to the hull assembly.

The support means preferably includes a left arm restraint band and a right arm restraint band, each securely connected to the hull assembly. A rotatable shaft assembly is rotatably mounted to the hull assembly and extends substantially perpendicular to the longitudinal axis. The rotatable shaft assembly supports the thruster means. Furthermore, left grips and right grips are provided, each grip being securely attached to the shaft assembly at a respective side of the hull assembly. The grips have control means for controlling power to the thruster means. The person utilizing the apparatus extends his arms through the restraint bands and grips the left and right grips, thereby allowing the person to control the relative angle of the hull assembly with respect to himself, his wrist action providing control of the relative angle between the hull assembly and the thrusters, and at the same time his hands allowing control of the power to the thrusters.

Thus, the present invention provides heretofore unavailable complex dollie and crane type camera movements with very unique cinematic results for underwater photography.

Although particularly adaptable for use with underwater cameras, it is understood that this vehicle is not limited to such a function and may be used for any type of recreational or utilitarian purpose in which enhanced maneuverability and ease in travel is desired. In view of these other utilities, it will be understood that the application regarding underwater photography is purely illustrative and not limiting in nature.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE INVENTION

Figure 1:
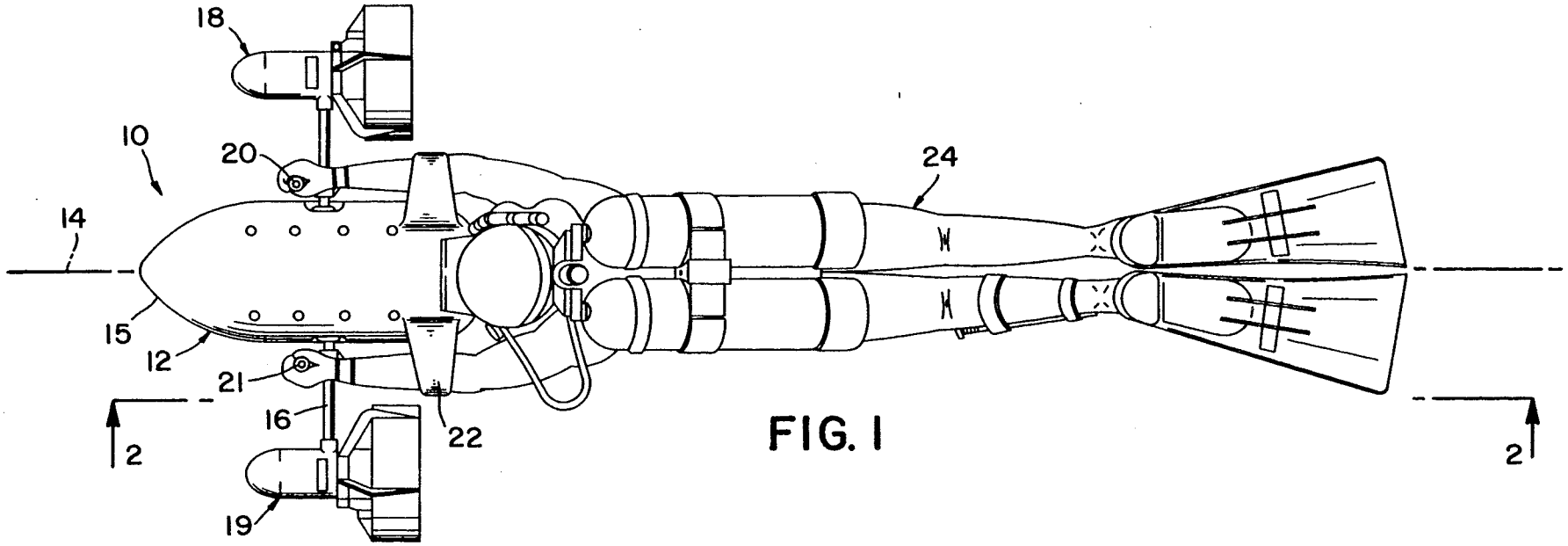
FIG. 1 is a top perspective view of a person utilizing the apparatus of the present invention.
Figure 2:
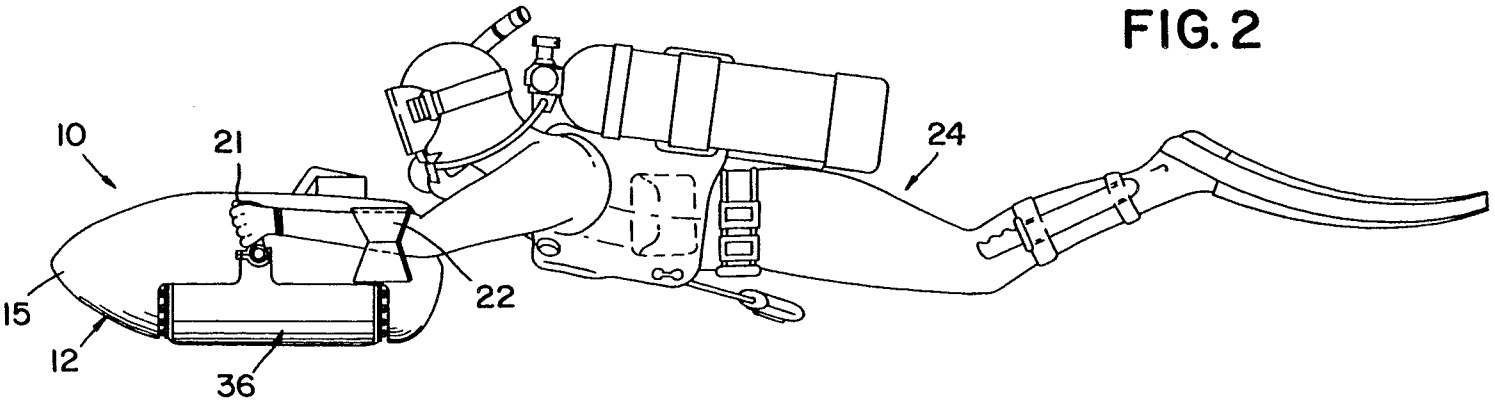
FIG. 2 is a side view of a person utilizing the apparatus, shown along line 2—2 of FIG. 1.

Referring to the drawings and the characters of reference marked thereon, FIG. 1 illustrates a preferred embodiment of the present invention, designated generally as 10. The invention comprises a hull assembly 12 with a central longitudinal axis 14. The hull assembly 12 includes an outer buoyancy shell 15. The hull assembly 12 also includes a pressure hull 36 which fits within the outer buoyancy shell 15, as shown in FIG. 2, for further providing the required buoyancy of the apparatus 10. The pressure hull 36 supports the power source and concomitant electrical circuitry to provide rotation of rotatable shafts 16 extending from each side of the hull assembly 12 substantially perpendicular to axis 14.

Each shaft 16 rigidly supports a respective thruster assembly 18, 19 for providing propulsion. Each shaft 16 also supports handling means or grips 20 for controlling the output of the thruster assemblies 18, 19 and for rotating the shafts 16 to control the angle of the thruster assemblies 18, 19 relative to the hull assembly 12. Each grip 20, 21 may be grasped by the hands of the user.

Furthermore, as may best be seen by reference to FIG. 2, the grips 20, 21 cooperate with rigid arm restraints 22 integral with or secured to hull assembly 12 to allow the user 24 to acquire control of the angle at which the hull assembly 12 is to be pointed regardless of the direction in which it is propelled. (It is noted that the thruster assemblies have been deleted from this figure for the purposes of clarity.)

Figure 3:
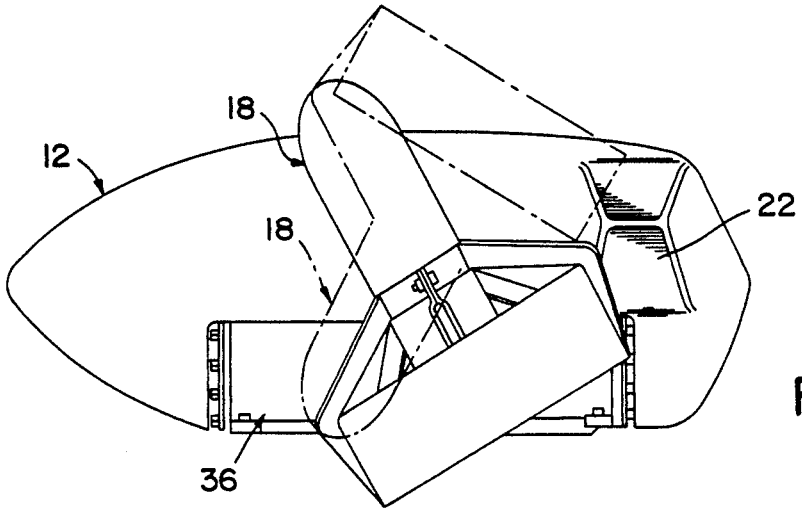
FIG. 3 is a side elevational view of the apparatus of the present invention, shown in two positions.

Thus, the thruster assemblies 18, 19 may be positioned in the same direction as the hull assembly 12, or as illustrated in FIG. 3, the thruster assemblies may, in another position (designated 26) be directed at a positive relative angle to the hull assembly or, as illustrated in phantom lines 28, the thruster assemblies may be directed at a negative relative angle to the hull assembly 12. Such a relative angular disposition is provided by the user simply turning his wrists in or out. A full 180° of rotation may be provided.

Figure 5:
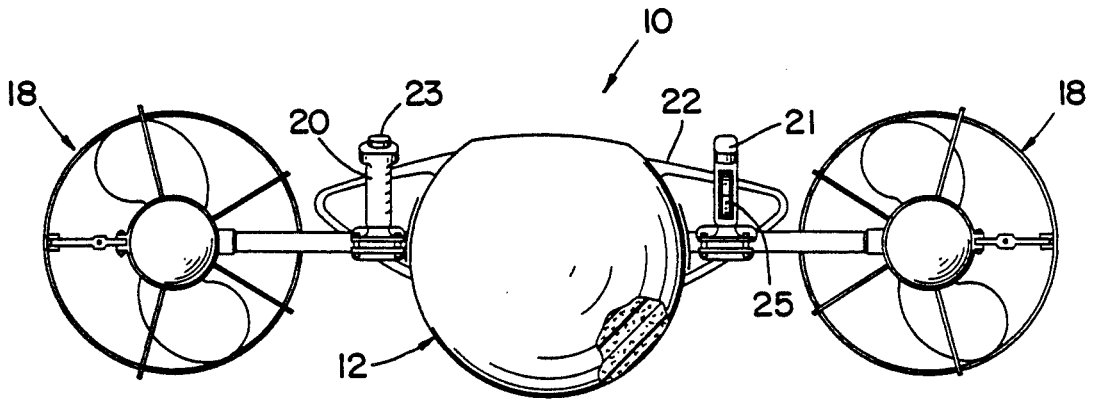
FIG. 5 is a front view of the apparatus of the present invention, taken along line 5—5 of FIG. 1.

Referring now to FIG. 5, it can be seen that the rigid arm restraints 22 are rigid V-shaped bands designed in such a way so as to allow the operator to pass his forearms through the bands to grip the right and the left side grips 20, 21. Once the operator has the grips in hand he can then turn his forearms in an outward direction within the V-shaped bands to passively restrain them as well as to control the relative angle of the hull assembly 12. Grip 20 has a master power button 23 for turning the thrusters on and off. Grip 21 has a rocker switch 25 for controlling the magnitude of the thrust.

As can be further noted by reference to FIG. 5, each thruster assembly 18 includes a casing 30 for a motor which powers a propeller 32 for providing thrust. A propeller shroud 34 provides user protection.

Figure 4:
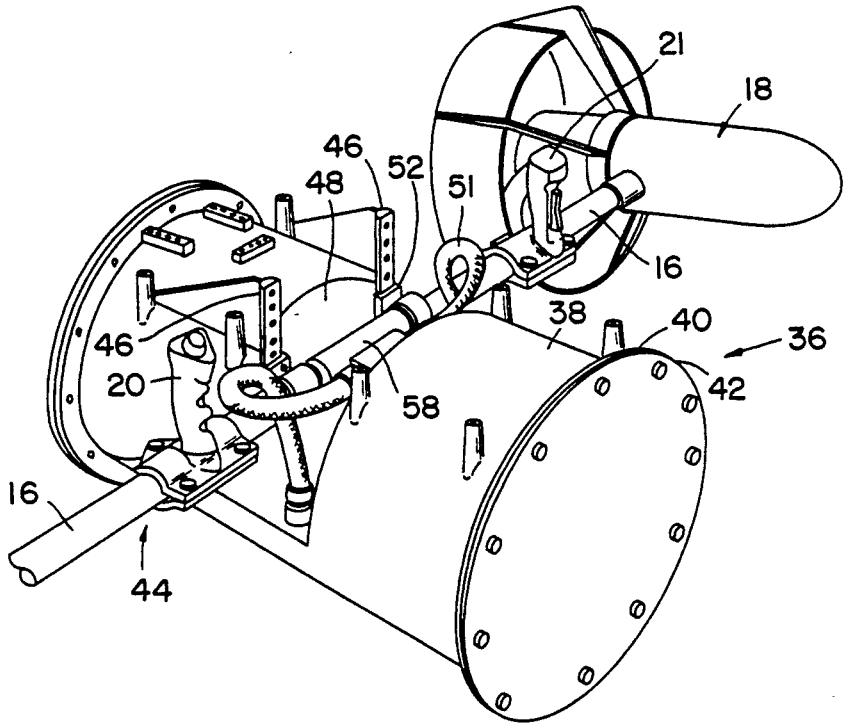
FIG. 4 is a front perspective view of the apparatus with the shell and one of the thruster assemblies removed to expose the pressure hull.

Referring now to FIG. 4, a front perspective view of the apparatus 10 is illustrated, with the shell 15 removed to expose the pressure hull, designated generally as 36. (Additionally, one of the thruster assemblies, e.g. the thruster assembly 18, is removed in this figure.) The pressure hull 36 is a lightweight Aluminum weldment consisting of a 10.25 diameter thin wall section of tubing 38 onto which are welded two end flanges 40 which are drilled and tapped to accept endplates 42.

The center section of the pressure hull 36 is notched to accommodate a thruster shaft assembly, designated generally as 44, which is attached to vertical tracks 46 that are welded to the aft bulkhead 48 of the notched area. A fore bulkhead and an aft bulkhead 48 are welded into place to form the sealed center section of the notch. An upper flat deck is added at the base of the notch to which all thruster and switch wiring bulkhead connectors are attached.

The thruster shaft assembly, designated generally as 44, includes a machined aluminum center coupling 58 through which high amperage thruster power lines 51 are routed from the pressure hull 13. The thruster shaft assembly 44 further includes the shafts 16 to which each thruster assembly 18 is firmly affixed. The hollow shafts 16 are preferably formed of sealed stainless steel. The thruster shaft assembly 44 is attached to the pressure hull 36 by means of two bearing blocks 52 bolted to the two vertical adjustment tracks 46 which are integral to the pressure hull 36. The bearing blocks 52 consist of stainless steel outer shells with nylon bearing liners.

Figure 6:
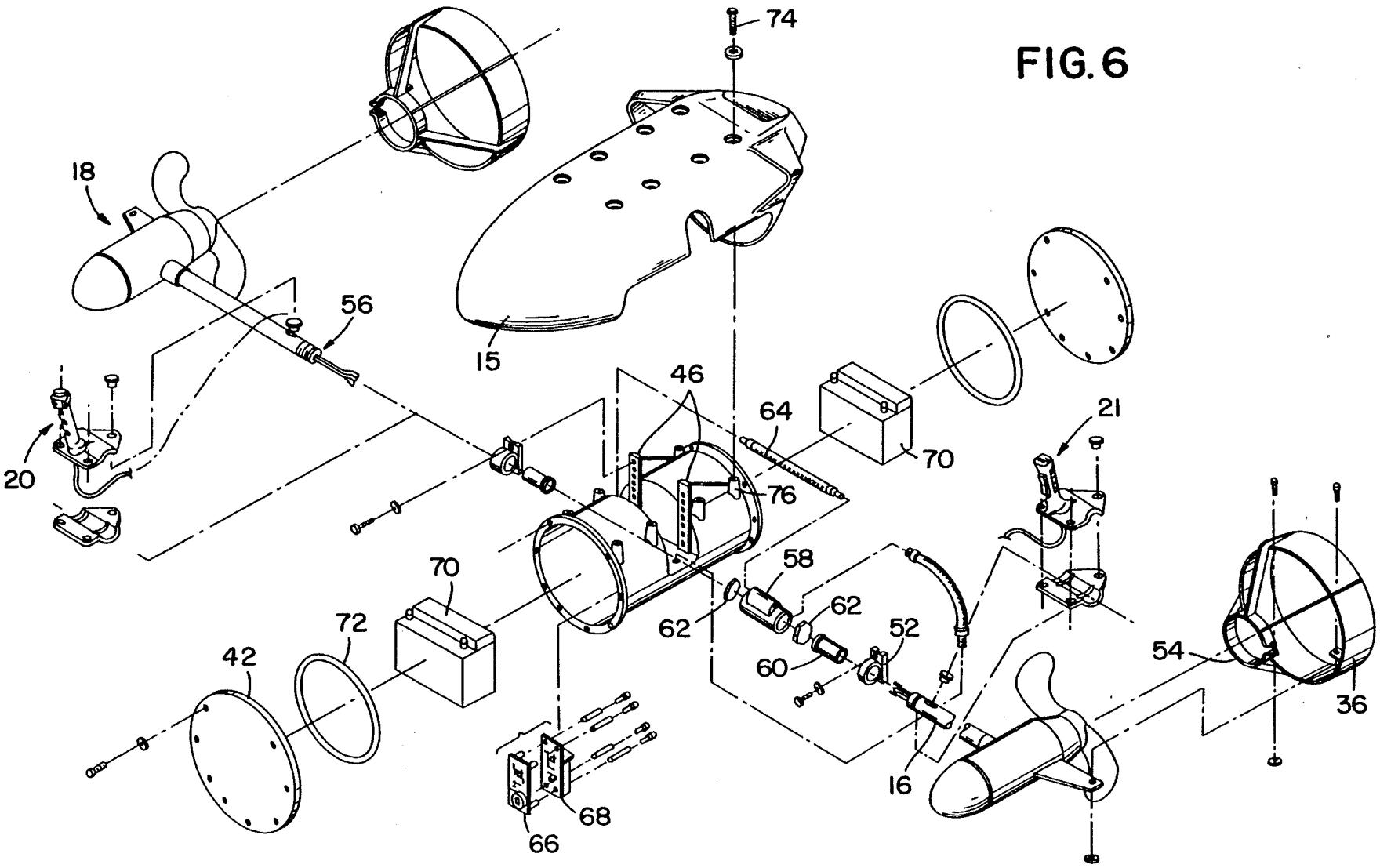
FIG. 6 is an exploded perspective view of the apparatus.

An exploded perspective view of the apparatus 10 is illustrated in FIG. 6. As can be seen by reference to this figure, each propeller shroud 34 is locked in place by an integral clamping ring 54.

The rotatable shaft assembly, 44, for supporting the thruster assemblies 18, 19 includes the center coupling 58 which supports pivot shafts 16 on each end. The center coupling 58 also provides access to the power lines. The shafts 16 are connected through bushings 60 and nuts 62. Each bushing 60 and pivot shaft 16 fits within the bearing block 52 which attaches to the vertical tracks 46. A connector 64 is utilized to connect the power line 51 to the circuit board 66 which is attached to the bulkhead 48. The circuit board 66 may include the servo motor speed control and speed control circuit board.

A leak detector printed circuit board 68 is attached adjacent circuit board 66. In assembly, these circuit boards are attached to their mounts on the bulkhead 48 and wired together. Aircraft gel cell batteries 70 are then carefully slid into position from either end. Hydrogen catalyst capsules are then installed to avoid explosive hydrogen gas buildup during battery charging. Endplates 42 are then attached with O-rings 72 to finish seal the entire pressure hull. The shell 15 is bolted by bolt assemblies 74 to locations 76 on the hull.

Figure 8:
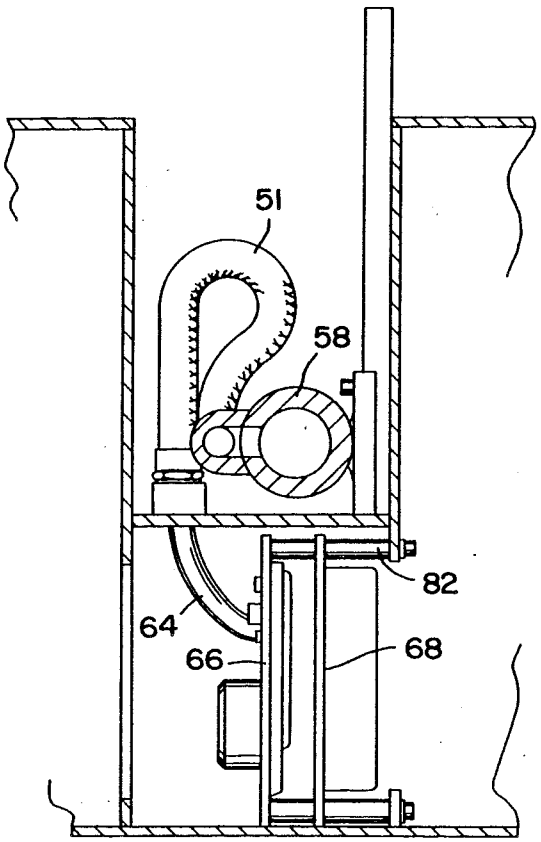
FIG. 8 is a view taken along line 8—8 of FIG. 7.
Figure 7:
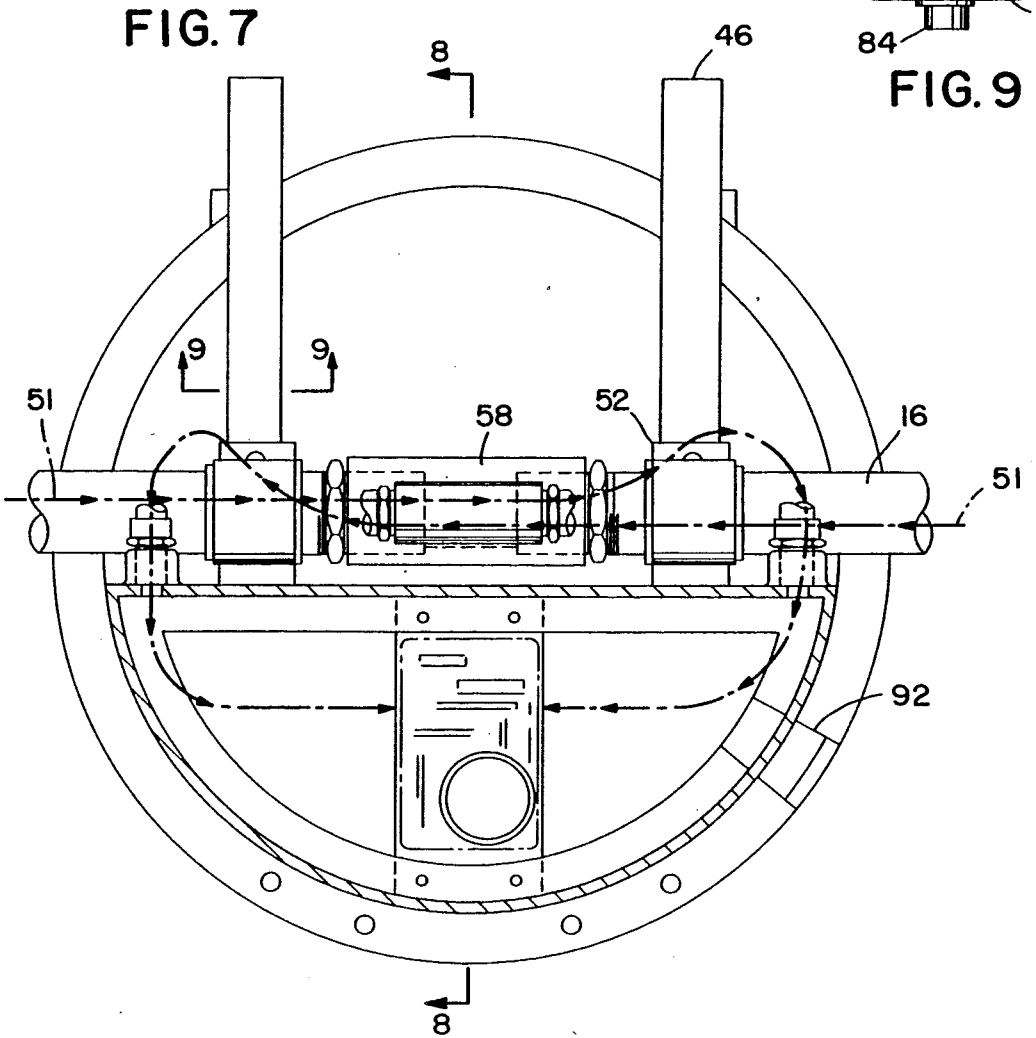
FIG. 7 is a sectional view of the apparatus taken along the center of the hull assembly.

Referring now to FIG. 7, the path of the electrical power lines is illustrated. As can be seen by dashed arrowed lines 51, the lines are routed from the switches, along the shaft 16 through the center coupling 58 and into the pressure hull 36. Utilization of this small service loop permits a full 180 degrees of shaft rotation without stressing these wires. The same service loop is used for the low current lines routed from the switches along the shaft and into the pressure hull and for the high current thruster power lines exiting the central shaft coupling and connecting to the pressure hull. FIG. 8 illustrates this service loop. It also shows the manner in which the circuit boards are connected to the hull 13 through a bracket 82.

Figure 9:
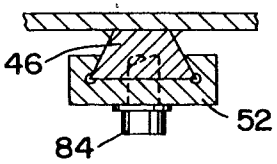
FIG. 9 is a view taken along line 9—9 of FIG. 7.

Referring now to FIG. 9, the relative engagement of the vertical track 46 with the bearing block 52 is illustrated. set screw 84 locks the bearing block into position. Use of a dovetail shape has been proven to be the most effective shape, allowing maximum support and ease in adjustment.

Figure 10:
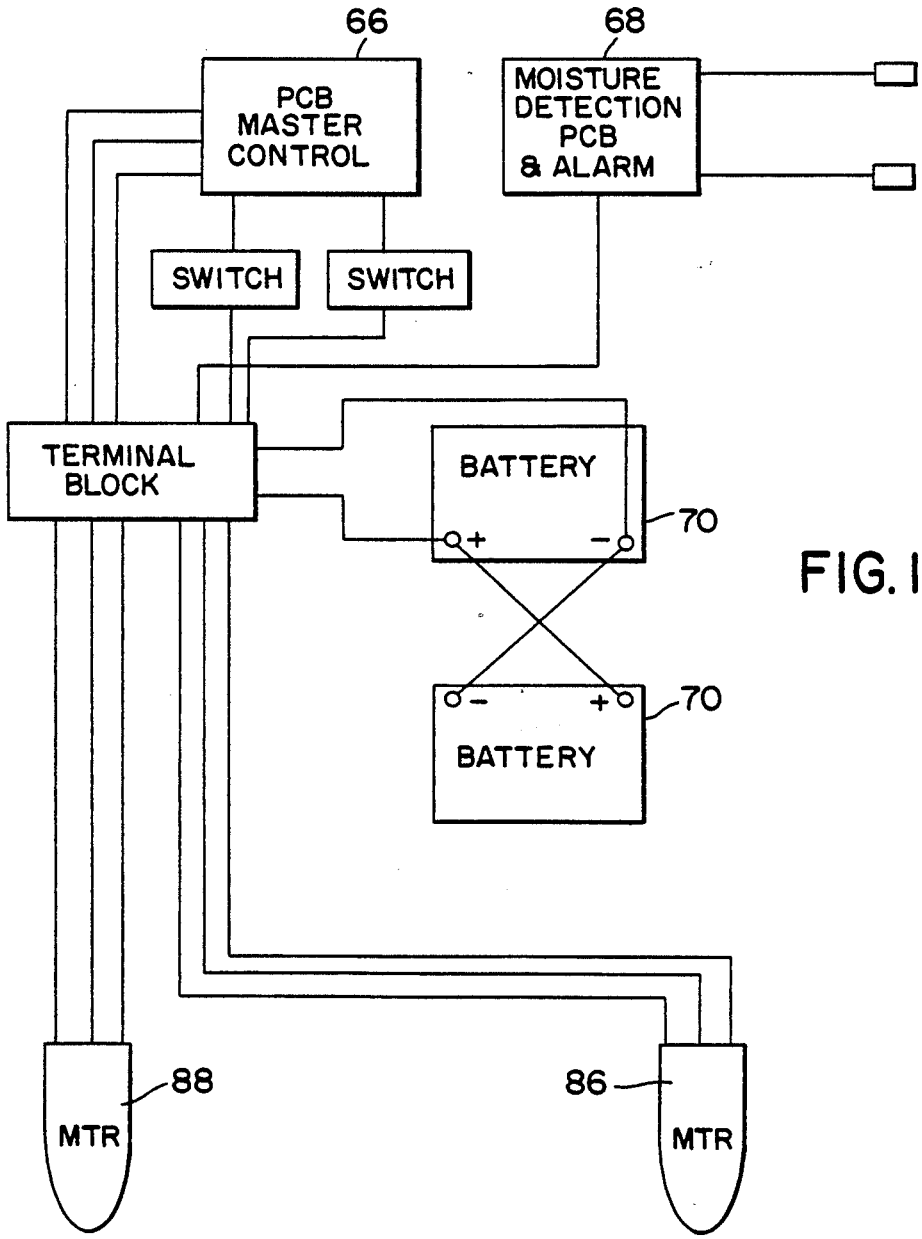
FIG. 10 is a schematic illustration of the electrical system of the present invention.

Referring now to FIG. 10, a schematic illustration of the electrical system of the present invention is illustrated. Each thruster assembly 18, 19 includes a 12-volt, 35 amp DC electric brushed motor 86 or 88 enclosed within a sealed pressure resistant casing. The motor drive shaft exits the aft section of the casing through an O-ring type seal (not shown) and is supported internally by a thrust bearing. To the drive shaft is attached a 10-inch diameter lexan marine propeller 32 (as shown in FIG. 5), including a brass shear pin (not shown). The thrusters are driven electrically in opposite directions producing a more desirable counter-rotating propeller effect neutralizing adverse vehicle axial roll due to torque. Positive control is further enhanced by propeller counter rotation as far as turning the vehicle is concerned, pull-in cavitation turns are of equal speed and magnitude to the right and to the left.

The motor speed control circuit, which is part of the printed circuit board master control 66 consists of an external pressure compensated double pole, double throw (DPDT) switch 25 with positive momentary-on contacts in either direction coupled internally to the small 12-volt low current drain DC servo motor which in turn drives a variable resistor in that motor speed control circuit.

The variable resistor output current is connected to an array of power MOSFETS (metal oxide semi conductor field effect transistors) whereby the higher output current from the array is varied in proportion relative to input current from the variable resistor.

Speed control to both thrusters is the same. They are not independently controlled. The vertically oriented variable speed switch 25 is located on the left hand grip 21. Advancing the motor RPM is accomplished by depressing the lower half of the DPDT switch 25 and holding it until the desired speed is attained. Releasing the switch will not change the power setting. If reduced RPM is desired, depressing the top half of the DPDT switch is required.

The master power on-off pressure compensated switch 23 is located on the right hand grip 20. Activating this momentary-on type switch 23 will drive the thrusters at whatever speed range has been selected by the left hand DPDT switch 25. Releasing finger pressure on the master on-off switch 23 will stop the motors regardless of what input is occurring from the speed control switch 25.

The internal leak detector circuit 68 consists of a simple moisture activated relay which is triggered by a preset resistance value connected to a bipolar transistor and diode. An output current from the relay triggers an oscillator circuit coupled to a beeper. The entire circuit is waterproofed except for the contact probes. There are four locations for these probes to help sense moisture in any vehicle attitude.

Figure 11:
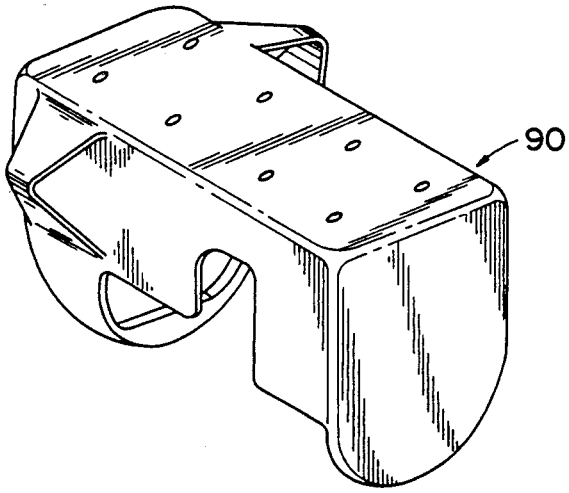
FIG. 11 is an alternate shell configuration specifically designed for use with photographic equipment.

The buoyancy shell 15 is constructed of a fiberglass resin and cloth covered sculpted high density foam shape of microspheres of material, preferably such as the material trademarked under the name "SEA-FOAM". The high density foam is very pressure resistant and compression is not measurable above the designed operating maximum depth of 250 feet seawater. The buoyancy shell 15 is designed to be easily removed from the aluminum pressure hull to provide service access to the hull and to allow complete reconfiguration of the entire vehicle by changing the buoyancy shell 15 from the streamlined speed oriented shell illustrated in the aforementioned figures to an alternate utilitarian modular camera and equipment carrier shell, designated generally as 90, in FIG. 11. Both shell configurations provide over 60% of the vehicle submerged buoyancy which is designed to be exactly neutral in seawater.

The buoyancy of each of the available shell configurations may be adjusted by as much as 10 pounds either positive or negative. This is accomplished by the addition or removal of pre-formed foam sections (not shown) contained within the fore and aft sections of the shell 15. The upper surface of the streamlined shell has a flat deck to which a small aquatic camera housing or other equipment can be attached with any combination of the eight available fastener locations which extend through the upper section of the shell down to the hard points of the aluminum pressure hull below. These eight attach points also can serve as a means of positively securing the shell to the pressure hull although four stainless steel locking cam latches are all that is required.

The box like utilitarian camera carrier shell 90 is of the same material construction as the shell of the previous embodiment; however, its shape has been altered to better accommodate a wide variety of aquatic camera housings, video monitors, underwater lighting systems and other underwater photography equipment. It has a large flat surface on top which forms a stable platform with which to affix equipment firmly to the machine. It has a blunt, flat nose to permit a closer coupling of camera housing and vehicle for better maneuvering and less drag when the choice is to push or pull the camera housing through the water on the same central longitudinal axis as the thrusters.

In operation, before the vehicle is lowered into the water, a pre-entry check of all systems must be conducted to ensure proper and safe operation. The operator begins by checking that the charge port plug 92 (see FIG. 7) is secure and there is 20 psi positive pressure within the hull. Depressing a leak detector test switch will confirm that the leak detection circuit is functional if an audible beeping is heard. Satisfied that the vehicle is not going to leak and has been sufficiently charged for the anticipated dive profile, the operator can begin to carefully launch the vehicle usually with a davit from a boat or a dock, although it can be carried by one person into the water if a davit is not available. Care must be exercised while launching to avoid toggling the master on/off power switch 23 which might present a hazard to hands, fingers, or equipment which have been carelessly positioned inside the aft access of the propeller arc.

Once the vehicle is launched, it is immediately checked visibly from all attitudes for bubbles which would indicate possible leakage. Next the desired buoyancy is set by adjusting the foam inserts to compensate for payload if any. Usually the vehicle is trimmed for neutral buoyancy for most operations.

The operator having already checked that his personal dive gear is functioning and does not pose a threat of becoming fouled in the propellers 32 passes his hands and forearms through the V-shaped forearm bands 22 until attaining a comfortable grip on the thruster shaft grips. By simply camming the forearms outward the forearm becomes gently wedged into the V-shaped bands. At this point the operator can be stretched out prone or in an upright position depending on what kind of propulsion direction command he is about to give the machine.

With both grips in hand the operator can begin to rotate the thruster shaft assembly 44 to the desired flight attitude with inputs from the wrist muscles. For example, if the desired flight path for both the thrusters and the longitudinal centerline of the vehicle is straight ahead with a stretched out prone diver to follow, then the thrusters are aligned to the vehicle centerline, hands on grips and forearms are locked by muscle and the master on switch is toggled. The vehicle will advance in a near straight forward line with minor vertical attitude changes to hold altitude constant made by subtle rotation of the thruster shaft assembly 44.

If the vehicle is desired to ascend, then a small aft pull back on the grips will rotate the thruster output downward (nose of thruster pointing up) which will cause the vehicle to begin rising regardless of whether or not the nose of the vehicle is pointing up (vehicle nose attitude is by forearm input). By rotating the thruster output down further by coming back more on the grips vertical speed will begin to increase while forward speed will diminish. This same set of events applies to pushing the grips forward to descend, however some additional push force is required to compensate for the fact that the vehicle is pulling the diver forward and drag acting on the diver and his equipment is imposing a force in the opposite direction. These forces are easily overcome with minimal muscle control. During accelerated flight the fins of the diver can be used to assist with lateral axis pitch control as well as longitudinal axis roll control.

The vehicle is capable of near vertical ascents and descents, however the nose of the vehicle and relative forearm angle are limited to less than 40 degrees of adjustment in the extreme vertical modes. As the diver transitions from straight and level flight where the body is usually stretched out prone to upward vertical flight, the body positioning must begin to change to a more vertical stance if the change to vertical is dramatic enough to reduce forward speed to nill. When transitioning to a dramatic downward vertical flight mode it becomes necessary for the diver to bring his knees up in close to the body and to hold the legs firmly together with dive fins if worn crossed over each other slightly so as to reduce drag on these areas and to make for a more comfortable posture while moving in this attitude.

Turning the vehicle in most flight attitudes where the vehicle if fairly level in the longitudinal roll axis is accomplished by the diver pulling the grip on the side to which he wishes to turn in toward himself. This rotates the vehicle about its vertical axis, causing the opposite thruster to suddenly move more rapidly while tracking the outer arc and generating slightly more thrust to assist in developing the turn. At the same time, the thruster that has been pulled in toward the diver is suddenly shadowed by the forward buoyancy shell area creating a burble effect in the water passing through the propeller and thruster shroud, dramatically reducing thrust output.

The result of both of the above simultaneous actions results in a quick turning capability. In fact, if the operator should so desire, he can pull in a thruster very rapidly resulting in a near perfect vertical axis rotation to reverse vehicle and soon to follow diver direction. Rolling the vehicle is easily done by first rotating the forearms in the desired roll direction with minimal muscle input followed by a repositioning of the diver's fins to a staggered posture, with the high fin on the high side of the roll. Positioning the fins in this manner is simply an extension of the natural tendency for the legs to arrive in that attitude. Also, with the high fin now more vertical, it can be used as a rudder by small bends at the knee to enhance a roll/yaw couple turn. It is entirely possible, with only a little practice, to roll the vehicle through a full 360 degrees. If while rolled to the 90 degree point the grips are brought to full aft position, then rotating the thrust output suddenly in the opposite direction of flight will result in the vehicle and diver quickly reversing course on nearly the same course line. The vehicle is extremely maneuverable in pitch as well. When flown at high speeds, it is possible to actually loop the machine in a 360 degree arc.

One of the fundamental reasons for designing the vehicle with rotatable thrusters was to achieve the capability of aiming the lens of an attached underwater movie camera in one direction while having the capacity at the same time of propulsion of the entire rig in another flight attitude. It becomes thereby possible to accomplish complex dollie and crane type camera moves with very unique cinematic results for underwater photography.

The apparatus can travel at speeds up to four knots. It may operate at maximum depths of approximately two hundred feet.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. An apparatus for propelling a person in an underwater environment, comprising:

(a) a hull assembly for maintaining the apparatus at the desired level of buoyancy, said hull assembly having a longitudinal axis;

(b) support means for allowing said person to position said hull assembly at the desired angular orientation relative to siad person, said support means including arm restraint means securely connected to said hull assembly to allow said person to pass his arms through said arm restraint means and position said hull assembly as said desired angular orientation;

(c) thruster means connected to said hull assembly for propelling said apparatus through the water, said thruster means being positionable at the desired angular orientation relative to the longitudinal axis of said hull assembly, the hull assembly being angularly oriented independently of the direction of the movement of said apparatus; and (d) means for connecting said thruster means to said hull assembly.

2. The apparatus of claim 1, wherein said arm restraint means includes a left arm restraint band and a right arm restraint band, each securely connected to said hull assembly.

3. The apparatus of claim 2, wherein said means for connecting said thruster means to said hull assembly includes a rotatable shaft assembly rotatably mounted to said hull assembly and extending substantially perpendicular to said longitudinal axis, said rotatable shaft assembly for supporting said thruster means.

4. The apparatus of claim 3, wherein said thruster means includes a left thruster and a right thruster, each disposed at respective ends of said rotatable shaft assembly.

5. The apparatus of claim 4, wherein said support means further includes a left grip and a right grip, each grip being securely attached to said shaft assembly at a respective side of said hull assembly, the person utilizing said apparatus extending his arms through said restraint bands and gripping said grips, thereby allowing the person to control the relative angle of the hull assembly with respect to himself, the wrist action thereof providing control of the relative angle between the hull assembly and the thrusters.

6. The apparatus of claim 5, wherein one of said grips includes a master power switch coupled therewith for simultaneously activating both thrusters, and a second grip including a variable speed switch coupled therewith for simultaneously and dependently controlling the speed of both thrusters.

7. The apparatus of claim 6 wherein each of said thrusters is a DC brushed motor.

8. The apparatus of claim 2, wherein said hull assembly includes a pressure hull and a buoyancy shell connected to said pressure hull, said buoyancy shell fitting about said pressure hull.

9. An apparatus for propelling a person in an underwater environment, comprising:

(a) a hull assembly for maintaining the apparatus at the desired level of buoyancy, said hull assembly having a longitudinal axis;

(b) a rotatable shaft assembly rotatably mounted to said hull assembly and extending substantially perpendicular to said longitudinal axis, said rotatable shaft assembly for supporting thruster means;

(c) said thruster means including a left thruster and a right thruster, each securely attached to a respective end of said rotatable shaft assembly, each of said thrusters being oriented along parallel thruster axes;

(d) gripping means being securely attached to said rotatable shaft assembly for allowing the person to control the relative angle between said longitudinal axis and said parallel thruster axes;

(e) arm restraint means securely connected to said hull assembly, said arm restraint means being constructed and arranged so as to allow said person to pass his arms therethrough and to grip said gripping means, thereby allowing the person to control the relative angle of the hull assembly with respect to himself, the wrist action thereof providing control of the relative angle between the longitudinal axis and said parallel thruster axes; and (f) control means for controlling the power to said thrusters.

10. The apparatus of claim 9, wherein said control means are coupled to said gripping means.

11. The apparatus of claim 10, wherein said control means includes a master power switch for simultaneously activating both thrusters and a variable speed switch for simultaneously and dependently controlling the speed of both thrusters.

12. The apparatus of claim 11, wherein each of said thrusters includes a DC brushed motor coupled to a propeller.

13. The apparatus of claim 9, wherein said hull assembly includes a pressure hull and a buoyancy shell fitting about said pressure hull.

14. The apparatus of claim 13, wherein said pressure hull assembly includes means for providing neutral buoyancy.

15. The apparatus of claim 14, wherein said buoyancy shell is formed of fiberglass resin and cloth covered sculpted high density foam microspheres.

16. The apparatus of claim 13, wherein said buoyancy shell is shaped so as to support camera equipment.

17. An apparatus for propelling a person in an underwater environment, comprising:

(a) a hull assembly having a central longitudinal axis;

(b) a rotatable shaft assembly rotatably mounted to said hull assembly, extending substantially perpendicular to said central longitudinal axis, said shaft assembly having a first end and a second end;

(c) first thruster means and second thruster means, each securely attached to a respective end of said shaft assembly, said thruster means for propelling said apparatus through the water;

(d) first handling means and second handling means, each connected to said shaft assembly for providing user directed angular positioning of said shaft assembly relative to said hull assembly;

(e) control means for activating said thruster means; and (f) first and second arm restraints securely connected to said hull assembly for providing user directed positioning of the direction of said hull assembly.

* * * * *

UNITED STATES PATENT AND TRADEMARK OFFICE

CERTIFICATE OF CORRECTION

PATENT NO. : 4,996,938

DATED : March 5, 1991

INVENTOR(S) : Michael H. Cameron and James F. Cameron

It is certified that error appears in the above-identified patent and that said Letters Patent is hereby corrected as shown below:

On the title page:

In Field [73] Assignee:, delete "American Gothic Productions, Palm Desert, Calif."

Signed and Sealed this

Eleventh Day of April, 1995

*Attest:*

Bruce Lehman

BRUCE LEHMAN

*Attesting Officer*

*Commissioner of Patents and Trademarks*